US006044987A

United States Patent [19]

Marcus et al.

[11] Patent Number: 6,044,987

[45] Date of Patent: Apr. 4, 2000

[54] RETAIL APPAREL DISPLAY AND STORAGE STAND

[75] Inventors: Cory B. Marcus, Larkspur; Francisco Mejia, Oakland, both of Calif.

[73] Assignee: Presentation Systems a division of C.G.S.G., Inc., Richmond, Calif.

[21] Appl. No.: 09/317,091

[22] Filed: May 22, 1999

[51] Int. Cl.[7] ..... A47F 5/00

[52] U.S. Cl. ..... 211/169; 211/169.1; 211/97; 40/538

[58] Field of Search ..... 211/97, 96, 47, 211/48, 169, 169.1, 168, 13.1; 40/538

[56] References Cited

U.S. PATENT DOCUMENTS

| | | | |
|---|---|---|---|
| 978,995 | 12/1910 | Ellis . | |
| 2,158,986 | 5/1939 | Peshek et al. . | |
| 3,391,796 | 7/1968 | Cross . | |
| 3,777,896 | 12/1973 | Ehrlich | 211/169 X |
| 4,088,228 | 5/1978 | Schwalbe | 211/168 X |
| 4,291,811 | 9/1981 | Shaver | 211/169.1 X |
| 5,437,379 | 8/1995 | Wolf et al. | 211/47 X |
| 5,649,631 | 7/1997 | Loflin | 211/48 X |
| 5,921,413 | 7/1999 | Knight et al | 211/169 |

*Primary Examiner*—Robert W. Gibson, Jr.
*Attorney, Agent, or Firm*—David E. Newhouse

[57] ABSTRACT

A retail display and inventory storage stand for shirts and similar apparel includes a plurality of removable swinging display panels each including one or two internal torso frames over which a shirt or garment may pulled or fastened for displaying expression/designs appearing on the front and back of the garment, each internal torso frame being pivotally secured at its base to the bottom of the display panel for limited rotation within and perpendicularly relative to the plane of the display panel and having a top necked section extending upward adapted for capture by and fastening to the top of the display panel. The plurality of removable display panels are in turn received and mechanically supported within a rectilinear mounting frame for swinging rotation about vertically oriented parallel axes aligned with the respective planes of the display panel frames above a hexahedral base inventory storage structure providing a plurality of inventory compartments for storing folded shirts sorted by size and design/expression. Shirts or other garments displayed for sale are pulled down or fastened around the internal torso frames detached from the top of the display panel frame and rotated outward slightly when necessary. The necked top of the torso frame is then re-secured to the top frame member of the panel frame and the loaded display panels are then placed in the rectilinear mounting frame atop the hexahedral base of the stand. The removable, swinging rectangular display panels, occuping a minimal hexahedral volume, are swung back and forth by consumers examining the different designs/expressions on the fronts/backs of the garments pulled/fastened around the torso frames. Upon deciding upon a particular garment design/expression, the consumer then picks it folded/packaged from an appropriate size and design/expression inventory storage compartment located in and forming the hexahedral base of the stand.

7 Claims, 7 Drawing Sheets

RETAIL APPAREL DISPLAY AND STORAGE STAND

BACKGROUND OF THE INVENTION

1. Field of the Invention

The invention relates to a retail display and inventory storage stand for shirts generally and T-shirts particularly.

2. Description of the Prior Art

Artistic expression, meaning images, designs, and/or words printed or reproduced on planar materials (sheets of paper) such as art prints, posters are quite efficiently and successfully marketed, retail, using display and storage stands featuring multiple, removable, large area swinging panels for displaying exemplars of the artistic work on vertical surfaces supported above a base storage unit having a plurality of divided compartments (slots) storing rolled/packaged inventories of the different works displayed. Retail consumers swing the panels to view the various exemplar images and pick desired expression, already rolled/packaged from the appropriate inventory compartment (slot) in base of the storage unit.

Display and presentation of garments and wearing apparel is a very important aspect of retail marketing of clothing. In high fashion markets, attractive, live, clothed models model examples of a designer's artistry to private and public buyers. Retail spaces feature manikins stylishly clothed with various combinations of apparel to catch the eye and heart of the consumer. Retail spaces abound with strategically located, visually appealing arrangements composed of various apparel items to tickle the fancy and imaginations of consumers. Shirts and similar torso type garments (T-shirts & sweat shirts) not only express style but are also utilized for presenting artistic expression, both by the artist creating the expression and by the consumer wearing the expression.

However, consumers can not evaluate the full impact of an expression appearing on a garment when it is folded/packaged. Accordingly, shirts and similar torso garments making artistic and/or style statements are typically marketed on hangers hung on racks. Retailer's also frequently resort to displays of such garments on vertical surfaces in areas proximate to shelves on which inventories of displayed items are sorted and stored according to size/style/brand/etc., e.g., the classic man's (white) dress shirt Yet in most retail environments vertical display space is limited.

In more plebian markets, retail clothes rods, arms, racks and stands display and store hanging inventories of unfolded shirts, and torso garments using a myriad of different types of removable hangers which hooks onto a clothing rod of the rack, arm or stand. Typically such apparel items are sorted and hung utilizing a sorting criteria such as brand, size, style, and expression.

Consumers sort through shelved and hung apparel inventories, hands on, removing hangers from racks on which desired garments are hung, or if shelved, removing, and unpacking/unfolding the items for critical examination (expression and workmanship). If not satisfied (hopefully), the consumer will rehang/refold the garment and place it back on the respective rack or shelf from which it was taken in the appropriate brand/size/style/expression location. If satisfied initial after visual examination, but uncertain about fit, the consumer may then take the apparel item with hanger and packaging (maybe) to a fitting room to try on. If dissatisfied after trying on a garment, the consumer may return the garment to the rack or shelf from which it was taken, but most likely will place (toss) it with or without hangers and packaging on a tried-on rack or bin conveniently located close to the fitting room. Once satisfied, the consumer takes selected garment(s) to a purchasing counter where a retail clerk winnows any out hangers still connected with the apparel, and assuming the price and inventory identification tags are still attached, checks, folds and bags the garments and collects the appropriate lucre from the consumer, completing the transaction.

Retail clothing and wearing apparel stores expect and are staffed for re-hanging, re-folding re-packaging and sorting apparel examined, tried-on and discarded by dissatisfied consumers. As retail shelf/rack time passes (and merchantable value drops) unselected hung and folded garments move onto sale racks and into toss bins where consumers pick through the hodgepodge seeking out those value/quality items just to good to pass up. In such environments, apparel items securely packaged in a manner which discourages unpacking retain value longer. However, secure packaging defeats marketing of apparel items where value resides in the expression presented as opposed to style and fit criteria

SUMMARY OF THE INVENTION

A retail display and inventory storage stand for shirts and other torso garments includes a plurality of vertically oriented, removable, swinging display panels each including one or two internal torso frames over which a shirt may pulled or fastened for displaying expression/designs appearing on the front and back of the garment. Each torso frame is pivotally secured at its base to the bottom of the display panel for limited rotation within and perpendicularly relative to the plane of the display panel and has a top necked section extending upward adapted for capture by and fastening to the top of the display panel. The plurality of removable display panels are in turn received and mechanically supported within a rectilinear mounting frame for presenting vertically oriented, swinging display surfaces pivoting on parallel axes aligned with the respective planes of the display panel frames above a hexahedral inventory storage base stand. The hexahedral base inventory storage stand provides a plurality of inventory compartments for storing folded/packaged shirts sorted by size and design/expression.

Shirts and similar torso garments displayed for sale are pulled down over or fastened around the torso frames which are detachable from the top of the display panel frame for slight outward rotation necessary for pull over garments (T-shirts). The necked top of the torso frame is re-secured to the top frame member of the panel frame and the loaded display panels are then placed in the rectilinear mounting frame atop the hexahedral base of the stand. The removable, swinging rectangular display panels are swung back and forth by consumers examining the different designs/expressions on the fronts/backs of the shirts and apparel items pulled/fastened around the torso frames Upon deciding upon a particular design/expression, the consumer then picks the selected apparel item, folded/packaged, from the appropriate size and design/expression inventory storage compartment located in and forming the structural base of the stand.

The primary advantage of the invented retail shirt display and storage stand is that a relatively large number of vertical display surfaces are provided in a minimal hexahedral volume for allowing consumer examination of style, workmanship, and expression of exemplar garments with inventories of the displayed garments folded/packaged conveniently sorted and stored within the base of the stand.

An aspect of the invented retail shirt display and storage stand is that the display panels are removable from the rectilinear mounting frame, allowing each display panel to be expeditiously and easily removed and replaced with another display panel presenting different apparel item(s) in the event inventory of particular displayed apparel item(s) become exhausted. Alternatively, the displayed apparel item can be simply and quickly removed from a torso frame and be replaced with another shirt/garment pulled or fastened around the frame.

Still other aspects of the invented retail apparel display and inventory storage stand is that internal frames supported within the respective display panels can be configured for presenting different humanlike silhouettes around which different human apparel items can pulled or fastened for display.

The invented retail apparel display and inventor storage stand is particularly apt for merchandizing apparel items where value resides in the expression presented as opposed to style and fit criteria. For example, inventories of displayed apparel items can be and securely packaged folded and stored in the base of the stand to discourage consumer un-packaging

DETAILED DESCRIPTION OF PREFERRED AND EXEMPLARY EMBODIMENTS

Figure 1:
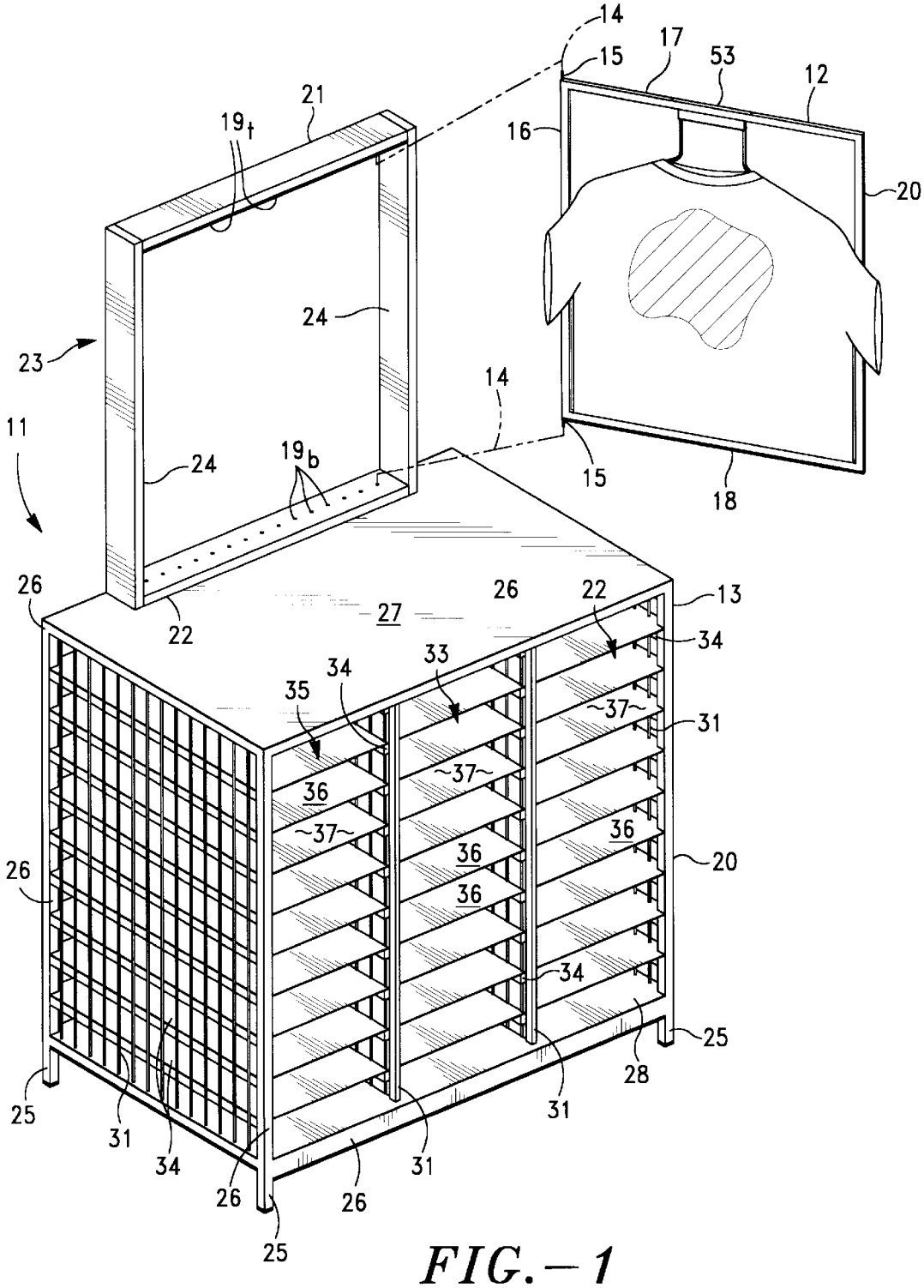
FIG. 1 is a perspective view of the invented retail apparel display and storage stand.
Figure 2A:
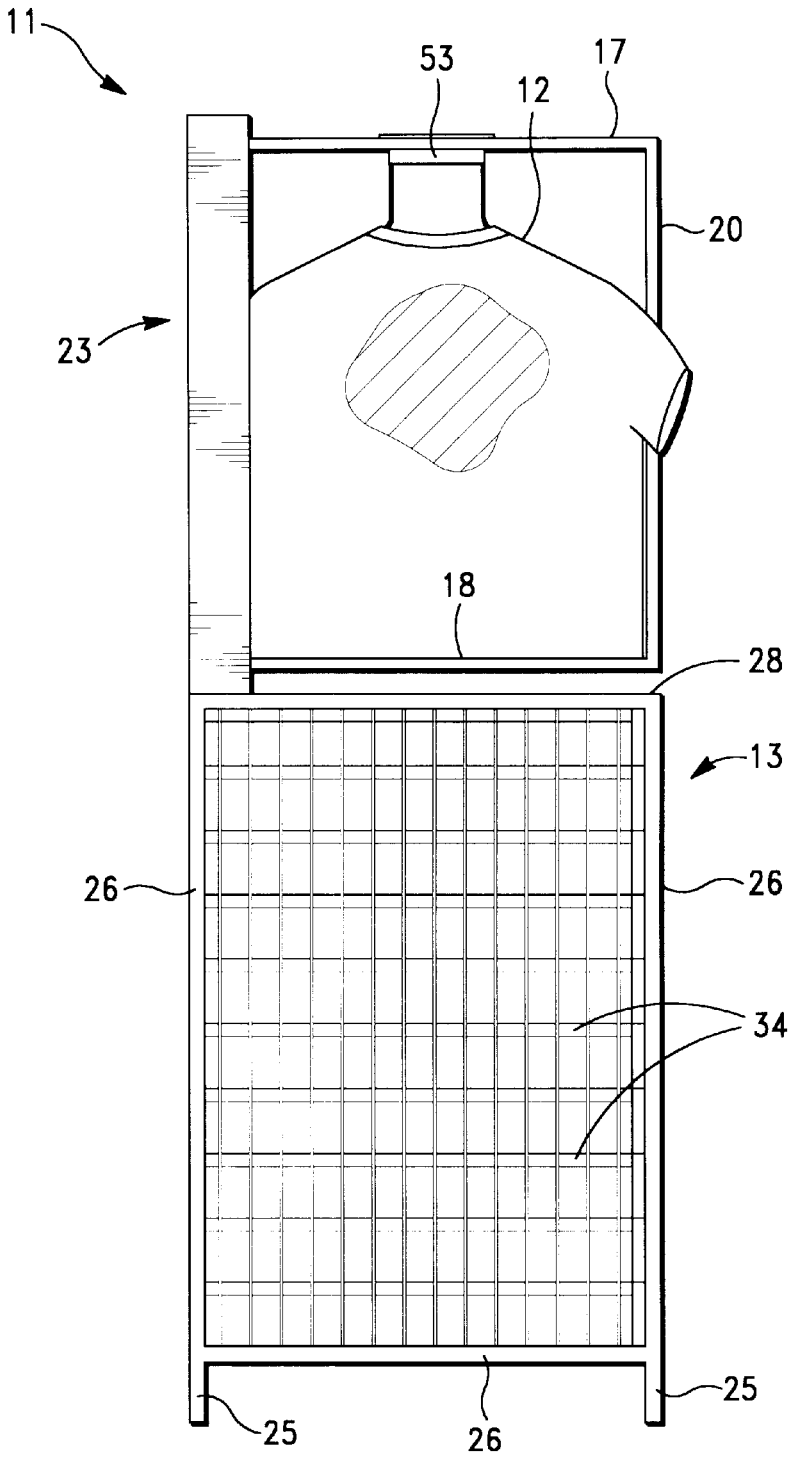
FIGS. 2*a*, 2*b* & 2*c* present side front and back elevation views respectively of the invented retail apparel display and storage stand.
Figure 2C:
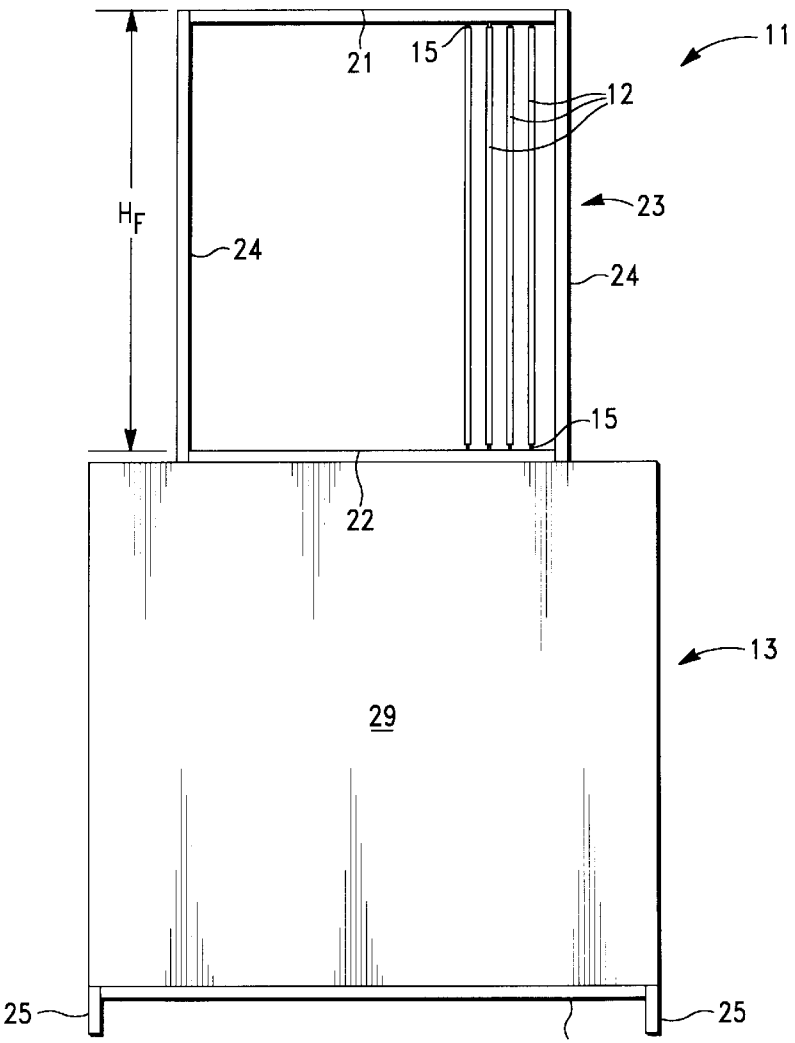
Figure 2B:
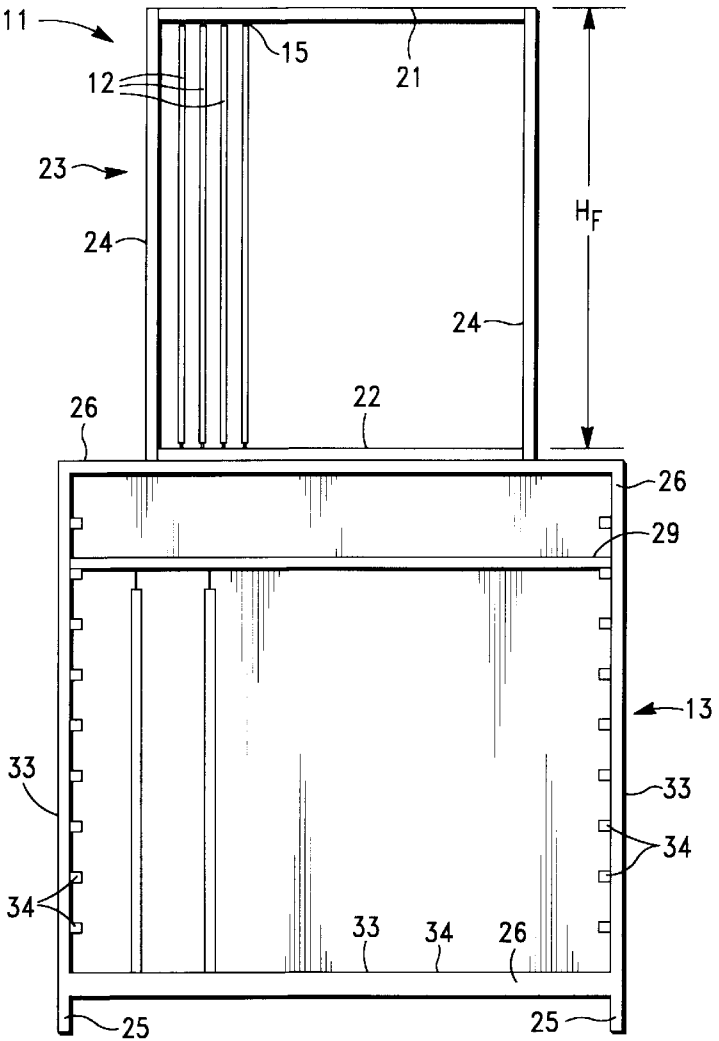

Looking at FIGS. 1, 2 *a–c* and 3, the invented retail display and inventory storage stand 11 supports a plurality of vertically, oriented removable, swinging display panels 12 above a hexahedral base 13. In particular, the display panels 12 each have a swing axis 14 defined by pins 15 secured at the back frame element 16 of the panel 12 that extend coaxially outward from the top and bottom frame elements 17 & 18 of the panel 12, respectively. The pins 15 defining the swing axis 14 of the display panels 12 may be located inward from the back frame element 16, however, spacing between adjacent panels must be increased if the adjacent panels 12 are to swing oppositely. The pins 15 defining the swing axis 14 of the panels 12 are received in vertically aligned holes 19 drilled respectively into top and bottom frame members 21 & 22 respectively of a rectangular mounting frame 23 secured to the hexahedral base 13 of the stand 11.

In more detail, the top frame member 21 of the mounting frame 23 is spaced and supported a height $H_F$ from its bottom frame member 22 by side frame members 24. Each hole 19*t* drilled into the downward facing surface of the top frame member 21 has a depth $d_T$. The corresponding vertically aligned hole 19*b* drilled into the upward facing surface of the bottom frame member 22 has a depth $d_b$. Each display panel 12 has a height $H_p$, the top pin 15*t* extends upward from the top frame element 17 a length $P_t$, and the bottom pin 15*b* extends downward from the bottom frame element 18 of a length $P_b$. The distance between the distal ends of the top and bottom pins 15*t* & 15*b* of each display panel 13 is W, where W is greater than the height $H_F$ of the mounting frame plus the depth $d_b$ of the bottom hole 19*b*, i.e.:

$$W>(H_F+d_b); \text{ and}$$

the height the mounting frame $H_F$ is greater than height of the display panel $H_p$ plus length $P_b$ of the bottom pin, i.e.:

$$H_F>(H_p+P_b); \text{ and}$$

the depth $d_t$ of the top hole is greater than the length $P_t$ of the top pin, i.e.:

$$d_T>P_t; \text{ such that:}$$

(i) by completely inserting the top pin 15*t* of a display panel into the hole 19*t* drilled into the bottom surface of the top frame member 21 of the mounting frame 23, the bottom pin 15*b* of the particular display panel 12 can be moved into and out of registry with the corresponding vertically aligned hole 19*b* drilled into the top facing surface of the bottom frame member 22 of the mounting frame 23; yet (ii) when the bottom pin 15*b* seats in the bottom hole 19*a*, the top pin 15*t* remains captured within the top hole 19*t*.

As shown in FIGS. 1, & 2(*a–c*) hexahedral base 13 of the invented stand 11 consists of tubular framing struts 26, preferably rectangular in cross-section welded or otherwise fastened together to define a hexahedral structural cage or frame with four supporting corner legs 25. Shear stability is provided to the hexahedral structural cage or frame by solid top, bottom, and back panels 27, 28 & 29 respectively. The solid top, bottom, and back panels 27, 28 & 29 should be composed of a compression resistant, non-buckling material such as ½ inch plywood, particle board, or like material. Vertical wire frame separators 31 are secured between the top and bottom panels 27 & 28 to close the sides of the structural cage or frame and to define vertical columns 33 within the structural cage or frame. A plurality of horizontally located rails/supports 34 are secured to the wire frame separators 31 for supporting shelf panels 36 within the respectively defined vertical columns 33. An inventory of folded/packaged shirts or other displayed clothing articles (not shown) are stored within the respective compartments 37 defined by the vertical wire frame separators 31 and shelf panels 36 sorted according to size, expression and/or other criteria Alternatively, rather than a plurality of storage compartments 37 for package shirts, one or more conventional hanger rod can be conventionally mounted and secured within the hexahedral structural base 13 of the invented stand 11 onto which an inventory of hung rather than packaged apparel items can be stored.

Likewise the mounting frame 23 supporting the swinging display panels 12 above the base 13 is formed preferably from hollow rectangular struts conventionally welded/fastened together and preferably secured co-planer with the back plane of the hexahedral base 13, such that the display panels 12 swing back and forth over the top panel 27 of the hexahedral base 13 constraining the center of mass (gravity)

of the stand vertically within the perimeter defined by the four supporting corner legs 25 of the hexahedral base 13 so that the stand is not easily tipped over.

Figure 3:
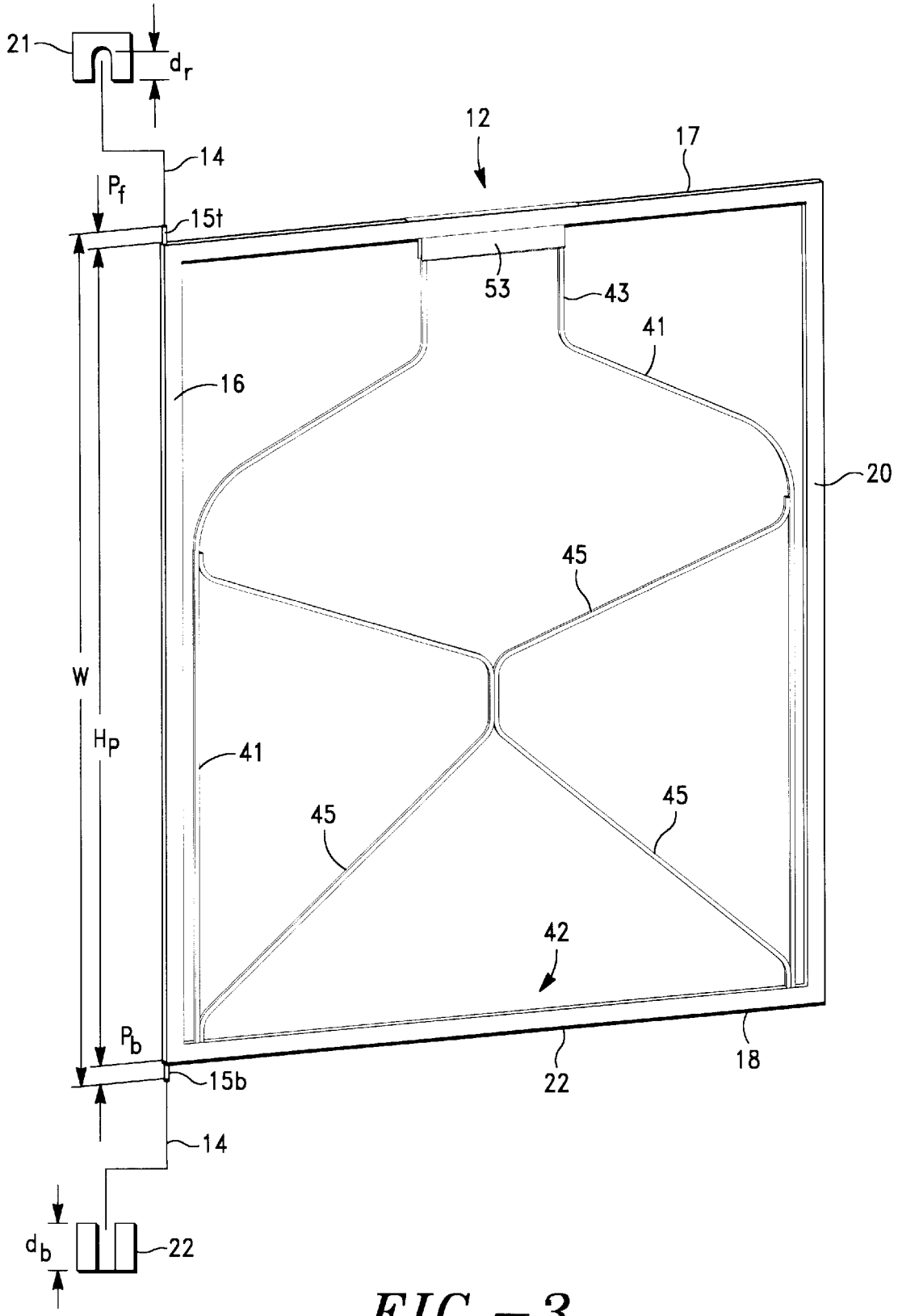
FIG. 3 is a perspective view of the removable, swinging display panel with an internal torso frame.
Figure 4:
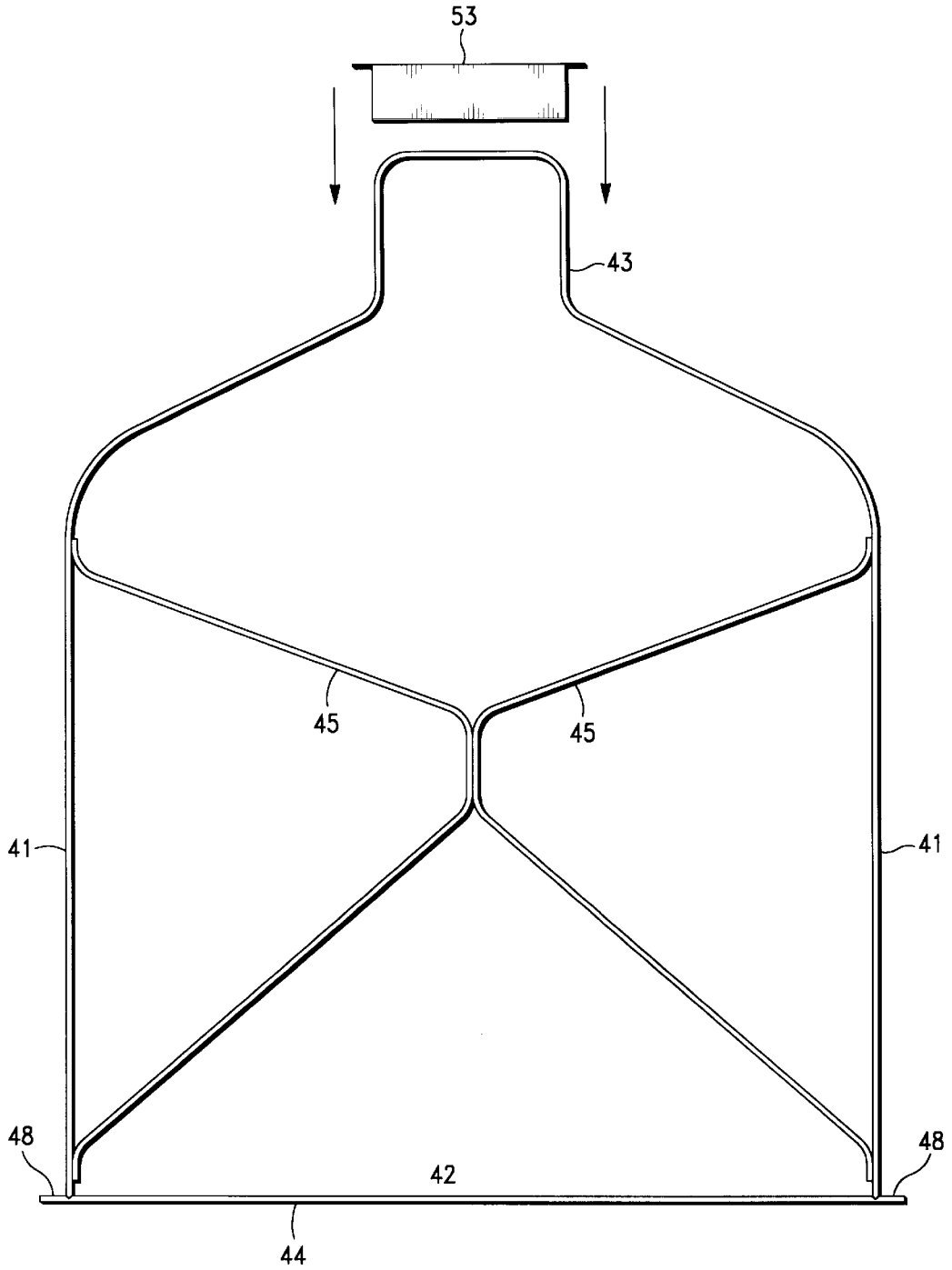
FIG. 4 is a side elevation view of a torso frame illustrating the cooperation of necked top with a capture/fastener element
Figure 6A:
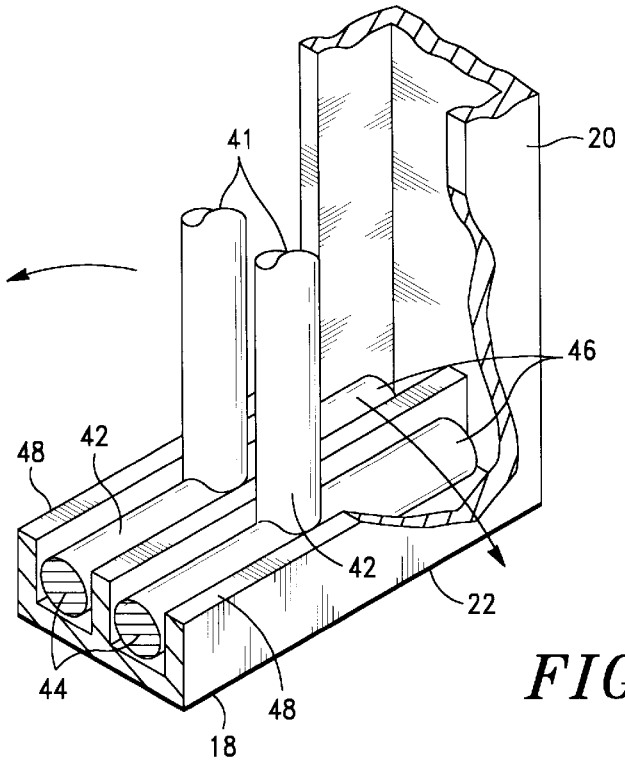
FIGS. 6*a*, 6*b* & 6*c* illustrate features the pivoting mechanical coupling between the bottom of the torso frame and the bottom framing member of the removable, swinging display panel.
Figure 6B:
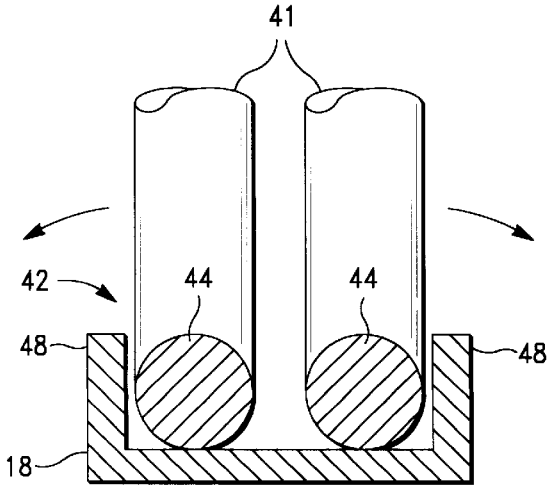
Figure 6C:
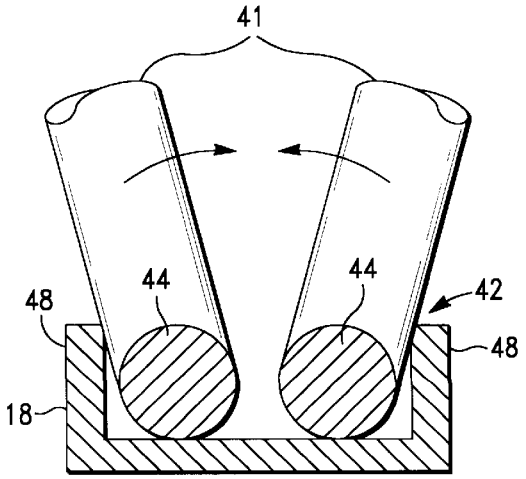

As illustrated in FIGS. 3 & 4 each swinging display panel 12 includes one or two internal torso or silhouette frames 41 over which a shirt may pulled or fastened for displaying expression/designs appearing on the front and back of the garment (see FIGS. 1 & 2*a*). As illustrated in FIGS. 6*a*–6*c* each torso frame 41 is pivotally secured at its base 42 within the bottom frame element 22 of the display panel 12 for limited rotation within and perpendicularly relative to the plane of the display panel 12. The torso/silhout frames have a top neck section 43 adapted for capture by and fastening to the top frame element 17 of the display panel 12. In particular, the torso frame 41 is formed by bending heavy gauge wire or rod to form 'U-shaped' silhouette closed at the top and open at the bottom resembling a human torso, neck to waist. Forming the base 42 of the torso frame 41 is a cross bar 44 of similar heavy gauge wire or rod conventionally welded/fastened across the ends, closing the open bottom of the 'U-shaped' silhouette. The width of the torso frame 41 at its widest is less than that of the display panel 12. However, the length of cross bars 44 of the torso frames is greater than the width of the torso frame 41, such that the cross bar ends 46 extend oppositely outward equally on each side of the U-shaped torso frame for centrally positioning the torso frame within the frame of the display panel 12.

As those with skill in display of clothing articles realize, the width of the torso frame 41 is greater than the planer width of a human torso because a heavy wire gauge or bent rod frame does not have a thickness comparable to that of a human torso. Coupled or crossing shear bars 45 join between each shoulder corner of the planar humanlike silhouette and opposite bottom corner of the torso frame 41 to prevent sideways bending or distortion of the frame 41 within its plane.

Looking at FIGS. 3, 5*a*, 5*b* and 6*a*–6*c* the back, top, bottom and side frame elements 16, 17, 18 & 20 of each display panel are formed of conventional rectangular U-channel structural struts conventionally welded/fastened to define a rectangular structural frame with the U-channels opening into the interior of the frame. Both the top and bottom frame elements 17 & 18 have a an inner cross section width at least equal to twice the diameter of the heavy gauge wire or bent rod used to form the torso frames 41. Accordingly each display panel 12 can accommodate at most two torso frames 41. The base cross bars 44 of the torso frames are received within the U-channel of the bottom frame element 18 of the display panel 12. Ideally, the side frame elements 16 & 20 of the display panel 12 could have cylindrical holes adapted to receive and secure the extending cross bar ends 46, which then could be conventionally secured to prevent sideways translation of the torso frame 41 within the display panel. Practically, however, it is easier to size the cross bars 44 for a compression fit between the side frame elements 16 & 20 within the U-channel of the bottom frame element 18, and then bend the sides walls 48 of the bottom U-channel frame element 18 inward slightly over the rod shaped cross bars 44 constraining them to stay within that U-channel.

Likewise, with reference to FIGS. 4, 5*a* & 5*b*, the height of the torso frame 41 is sized to fit within the display frame 12 such that the top crossing bar 47 of the neck section 43 is immediately below the side walls 48 of the top U-channel frame element. The top of the neck section 43 of the torso frame 41 can he captured and secured to the top frame element 17 of the display panel 12 by many different types conventional fastening and latching mechanisms. The skilled designer in selecting an appropriate fastening/latching mechanism should consider such factors as simplicity, elimination of structural elements that can catch/snag clothing articles, and security, both in a mechanical sense and a consumer sense. For example, simple, perceptible fastener/latch mechanisms would allow a consumer to unfasten or unlatch a torso frame for closer examination of a displayed clothing article. (Shopping consumers are notably lax when it comes to refastening something they have undone.) A swinging display panel 12 with a flopping torso frame 41 is not a desirable circumstance. On the other hand sales personal who must change the displayed clothing articles mustn't find or perceive the fastener/latch mechanism to the frustrating or complex.

Figure 5A:
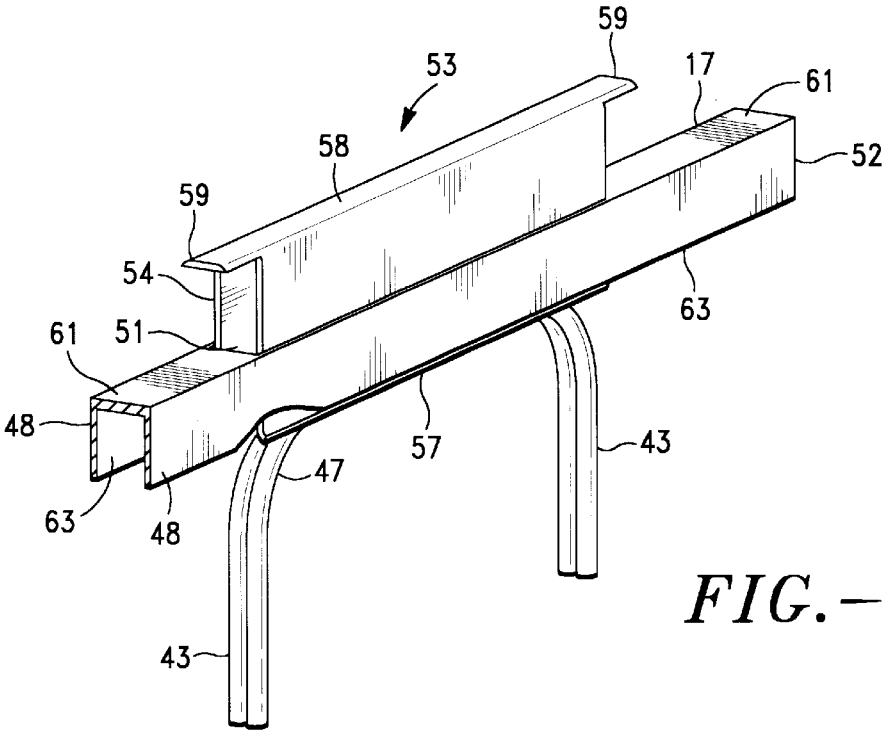
FIGS. 5*a* & 5*b* illustrate the mechanical interaction of the top of the necked section of the torso frame, the capture fastener element and the top structural framing member of the removable, swinging display panel.
Figure 5B:
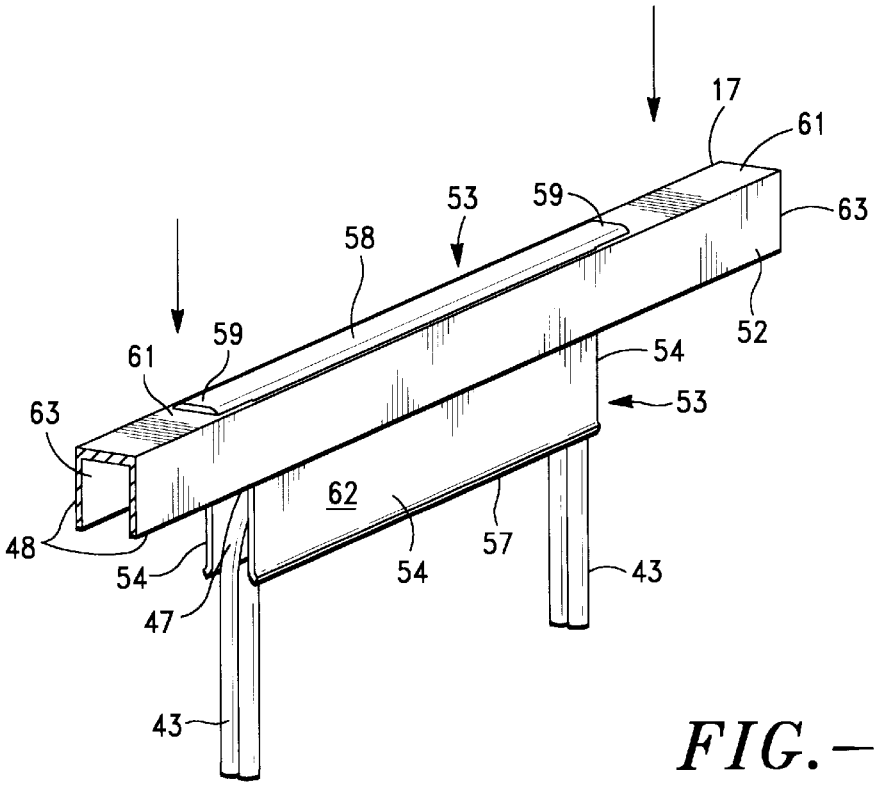

Addressing the recited concerns, the latch mechanism preferred for the invented retail display and storage stand 11 as illustrated in FIGS. 5*a* & 5*b*, comprises a combination of a latch slot 51 cut through the base of the U-channel of the structural strut 52 forming the top frame element 17 of a display panel 12. A U-shaped latch member 53 formed from sheet metal or a molded material has depending side legs 54 longer than the side walls 48 of the U-channel structural strut 52 with distal edges stepped outward to provide catching lands 57. The base 58 of the U-shaped latch member 53 has a length greater than that of the slot 51 whereas the length of depending side legs 54 is less than that of the slot 51 allowing the depending side legs to slide through the slot 51 and protrude downward beyond the side walls 48 of the U-channel of the structural strut 52. The extending tabs 59 of the top base 58 seat on the top surface 61 of the U-shaped channel of the structural strut 52.

The outer cross-section width of the latch member is sized slightly less than the inner cross-section width of the U-channel of the structural strut 52 such that the exterior faces 62 of depending side legs 54 sliding through the slot 51, frictionally engage the interior faces 63 of the side walls 48 of the U-channel. Accordingly, once the latch member 53 is pushed into the slot 51 and the depending side legs 54 extend beyond the side walls 48 of the U-channel of the structural strut 52, the outward catching lands 57 constrain translation of the latch member 53 in the slot 51 between: (i) an unlatched position with the catching lands 57 seating on the edges of the side wall 48 of the U-channel structural strut 52 (FIG. 5*a*); and (ii) a latched position with the extending tabs 59 of the top base 58 seated on the top surface 61 of the U-shaped channel of the structural strut 52 (FIG. 5*b*). The U-shaped latch member 53 may be completely removed from the slot 51 by manually squeezing the depending side legs 54 together to disengage the catching lands 57 from the edges of the side walls 48 of the U-channel of the structural strut 52.

As previously observed, the skilled designer should realize that if each display panel 12 is to present two torso frames 41, the inner cross-section width of the U-shaped latch member 53 should lee sufficient to receive and constrain two top cross bars 44 of the bent wire/rod torso frames 41.

The invented retail display and inventory storage stands has been described in context of wire gauge/bent rod silhouette frames shaped for displaying shirts, in particular pull over shirts such as t-shirts and sweat shirts. Many modifications and variations of the swinging display panels and internal wire gauge/bent rod silhouette frames can be devised and shaped for displaying many different types of garments and clothing articles, which, while not particularly described above, fall within the spirit and scope of the invention as set forth in the appended claims.

We claim:

1. A retail display stand for shirts comprising, in combination:

a) a plurality of display panels each providing a mechanical swing axle joining a top and a bottom of the display panel, defining a vertically oriented swing axis lying in a display plane;

b) a plurality of internal shirt torso frames over each of which a shirt may pulled for displaying expression/designs appearing on front and back surfaces of the shirt, each pivotally secured at the bottom of the display panel for limited rotation within and outward relative to the display plane, each shirt torso frame having a torso section and a top necked section extending upward adapted for capture by and fastening at the top of the display panel;

c) a mounting frame providing a row of spaced apart, parallel, vertically aligned top and bottom couplings, each vertically aligned, top and bottom coupling receiving and mechanically coupling to the axle of one display panel, the plurality of display panels being mounted in a row and swinging back and forth pivoting on their respective vertically oriented axes.

2. The retail display stand of claim 1 wherein:

the mounting frame is mechanical structure including top frame member spaced a distance $H_F$ from bottom member joined together by side frame members;

the vertically aligned top and bottom couplings are respectively a hole drilled into a downward facing surface of the top frame member of the mounting frame a depth $d_t$ and a hole drilled into an upward facing surface of the bottom member of the mounting frame a depth $d_B$;

the swing axle of each display panel is provided by a top pin extending upward from the top end of the display panel a distance $P_T$ and a bottom pin extending downward from the bottom of the display panel a distance $P_D$ coaxial with the top pin, where the top pin is received in the hole drilled into the top frame member, and the bottom pin is received within the hole drilled into the bottom member.

3. The retail display stand of claim 2 wherein:

a distance W exists between the respective distal ends of the top and bottom pins of each display panel where W is greater than the distance ($H_{F+dB}$);

a distance $H_P$ exists between the top and bottom of the display panel where ($H_p$+$P_D$) is less than $H_F$; and $P_T$ is less than $d_T$ whereby, completely inserting its top pin into the hole drilled into the bottom surface of the top member of the mounting frame its bottom pin can be moved into and out of registry with the corresponding coaxial hole drilled into the top facing surface of the bottom member of the mounting frame, for respectively mounting and removing the display panel from the mounting frame.

4. The retail display stand of claim 1 and further including:

d) a hexahedral base inventory storage structure providing a plurality of inventory compartments for storing folded shirts sorted by size and design/expression mechanically coupled to and supporting the mounting frame.

5. The retail display stand of claim 1 and further including:

d) a hexahedral base inventory storage structure providing at least one compartment for storing garments on hangers sorted by size and design/expression mechanically coupled to and supporting the mounting frame.

6. The retail display stand of claim 1 wherein the internal shirt torso frames each comprise in combination;

e) a downward opening, U-shaped bent rod frame defining a planar humanlike silhouette of a neck and torso;

f) a bottom bar perpendicularly joining between the open ends of the downward opening U-shaped bent rod frame defining base corners of the shirt torso frame and providing a pivot axis parallel to the planar humanlike silhouette;

g) a coupling pivotally securing the bottom bar of each internal shirt torso frame to the bottom of the display frame;

h) coupled crossing shear bars each joining between a shoulder corner of the planar humanlike silhouette and a bottom corner of the shirt torso frame.

7. The retail display and inventory storage stand of claim 6 and further including i) a removable clamping capture structure and wherein the top of the display panel is bar like and includes a clamp receptacle penetrating downwardly through the bar located centrally between its ends adapted to receive the removable clamping capture structure, the removable clamping capture structure being insertable into the clamp receptacle for capturing the top necked sections of the shirt torso frames mounted in the display panel preventing the shirt torso frames from pivoting outward relative to the display plane of the particular panel.

* * * * *